US006213280B1

(12) United States Patent
Abbadessa et al.

(10) Patent No.: US 6,213,280 B1
(45) Date of Patent: Apr. 10, 2001

(54) GRIPPER FOR CLAMPING FLAT ARTICLES

(75) Inventors: Stephen Edward Abbadessa; Richard Daniel Curley, both of Dover; Matthew Thomas Sharkady, Portsmouth, all of NH (US)

(73) Assignee: Heidelberger Druckmaschinen AG, Heidleberg (DE)

( * ) Notice: Subject to any disclaimer, the term of this patent is extended or adjusted under 35 U.S.C. 154(b) by 0 days.

(21) Appl. No.: 09/151,105

(22) Filed: Sep. 10, 1998

(51) Int. Cl.[7] ..... B65G 47/24

(52) U.S. Cl. ..... 198/377.02; 198/377.02; 198/803.7; 271/205

(58) Field of Search ..... 198/803.7, 377.02, 198/377.07; 271/204, 205

(56) References Cited

U.S. PATENT DOCUMENTS 3,671,035 * 6/1972 Reist ..... 271/204
3,726,389 * 4/1973 Klein et al. ..... 198/803.7
3,955,667 * 5/1976 Muller et al. ..... 271/204
4,072,228 2/1978 Honegger et al. .
4,550,822 11/1985 Meier .
4,982,944 * 1/1991 Eberle ..... 271/204
5,380,000 * 1/1995 Ohno ..... 271/204
5,740,900 4/1998 Cote et al. .

FOREIGN PATENT DOCUMENTS 0 312 755 4/1989 (EP) .

* cited by examiner

*Primary Examiner*—Joseph E. Valenza
(74) *Attorney, Agent, or Firm*—Burns, Doane, Swecker & Mathis, LLP

(57) ABSTRACT

The present invention is related to a gripper having a stationary gripper member and a movably mounted gripper member being relatively movable toward said stationary gripper member. An actuating member extends through the stationary and the movable gripper members respectively. Cam surfaces are assigned to said pretensioned actuating member being contacted by contacting members causing the gripper members respectively to close upon removal of external forces.

18 Claims, 4 Drawing Sheets

GRIPPER FOR CLAMPING FLAT ARTICLES

FIELD OF THE INVENTION

The present invention is related to a gripper for clamping flat articles for gripper conveyor systems or any material transport device that utilises a gripper to interface with the flat material, for instance for use in bindery equipment.

BACKGROUND OF THE INVENTION

U.S. Pat. No. 5,740,900 is related to an apparatus for splitting a product stream. An apparatus for splitting a product stream includes a conveyor belt entering a folder to grip products. The conveying belt comprises first and second product grippers arranged thereon in an endless configuration. The first grippers are selectively rotatable around an axis during movement of the conveying belt to allow for secondary stream of products to be formed. The gripper design used here allows for rotational movement of any other gripper out of the formation of conveyed flat products.

U.S. Pat. No. 4,072,228 discloses an apparatus for evening an imprecated stream of printed products. This configuration comprises a number of revolving entrainment members which are a drag connection with one another. At the region of this conveying active path the entrainment members are guided and at the start of the path driven by a thrust drive and at the end thereof driven by a traction drive. The entrainment members engage the printed products and the thrust and traction drive cause a change in the spacing of the entrainment members and, consequently, in the spacing of the products.

U.S. Pat. No. 4,550,822 shows an apparatus for transporting flat products, especially printed products arriving in an imprecated formation. Printed products arriving in an imprecated product formation are fed to space gripper units of transport device by a belt conveyor. The conveying direction of the belt conveyor forms an acute angle with the transport direction of the transport device. The transporting rate of velocity of the belt conveyor is greater than the transporting rate of velocity of the transport device. Each gripper unit comprises a stationary clamping jaw, a pivotable clamping jaw and a plate-shaped stop. The pivotable clamping jaw is pivoted against the action of a clamping spring by a cam structure or the like. The printed products are first accelerated and than pushed into the open gripper mouth until abutting the stop in order to thereby align the printed products at the region of their leading edges. At the region of their trailing edges, the printed products remain under the conveying action of the belt conveyer and at least until the gripper units are closed.

Existing designs which use springs to provide the gripping force do not allow both, a high gripping force and a large gripper jaw travel due to size and stress constrains on the spring. In addition, current latching gripper designs are prone to turn open and are sensitive to wearing of the latch parts.

SUMMARY OF THE INVENTION

In view of the prior art discussed it is accordingly one object of the present invention, to have a compact gripper having both a high gripper force and a large gripper jaw travel.

A further object of the present invention is to prevent a gripper from unintended turning open.

A still further object of the present invention is to provide a gripper which is less sensitive to component wear.

According to the present invention, a gripper comprises a stationary gripper member, a gripper member being relatively movable towards said stationary gripper member, and a pretensioned actuating member extending through the stationary and the movable gripper members, respectively, said pretensioned actuating member having cam surface portions being contacted by contacting members causing the gripper members to close upon removal of external forces.

The present invention offers several advantages over the latching mechanisms known in the art. A latching mechanism subject to wear and tear is completely eliminated, thus the reliability of the gripper actuating mechanism is significantly enhanced. The compact design of the gripper according to the present invention allows for aligning a large number of grippers in a conveying chain along a conveying track. Since the gripper is actuated by components, the surfaces of which are sliding with respect to each other, those surfaces can be treated by hardening; moving parts such as levers subject to wear can be eliminated completely.

According to further details of the present invention the stationary gripper member comprises a rotating lever for rotating movement of the stationary gripper with respect to the conveying direction along a conveying track. Said gripper comprises a conveying support to which on both sides thereof rollers are mounted to facilitate movement of the gripper according to the present invention along a conveying track. Further, a gripper support according to the present invention comprises connecting links for a chain-like arrangement of the grippers along a conveying track.

A stationary gripper member comprises a hollow interior within which a pushing member and a supporting members are mounted. Said pushing and said supporting members are mounted for relative movement towards each other which in turn causes the relative movement of both gripper members with respect to each other. The pushing member is pretensioned by a spring means such as a package of cup springs or a single cup spring or a package of helical springs or a single helical spring, depending upon the various production requirements such as gripper forces or gripper opening forces respectively. Still further, the spring means used for pretensioning the pushing member could be constituted by a gaseous medium.

The supporting member can be mounted to the movable gripper member, whereas the pushing member is encapsulated by the stationary gripper member. Both members may comprise upper and lower actuating means, respectively. Those could be rollers or roller bodies subjected to a hardening surface treatment. Said actuating means are mounted in recesses of said pushing or supporting member respectively. Those recesses have a diameter equal to the diameter of the roller bodies, in order to secure the roller bodies respective positions and locations.

Between the actuating means mounted in both the pushing and the supporting member, respectively, and cam surface portions of the plunger means extending through the pushing member and the supporting member, contacting members are journaled. Upon movement of the plunger means in vertical direction, said contacting members force the pushing member and the supporting member in opposite directions with respect to each other. This is achieved by having the cam surface portions of the plunger means have a different angle of inclination.

The present invention further discloses a method for actuating a gripper between a closed and an opened position.

Contacting members contact lower cam surface portions of an actuating means such as a plunger and roller body surfaces of roller bodies of pushing and supporting members in a closed position. Said contacting members contact upper cam surface portions of an actuating means such as a plunger and surfaces of roller bodies of pushing and supporting members in an open position.

BRIEF DESCRIPTION OF THE DRAWINGS

The above-mentioned and other features and objects of the present invention and the means of attaining them will be come more apparent and the invention itself will be best understood by reference by the following description of an embodiment of the invention taken in conjunction with the accompanying drawings.

DESCRIPTION OF PREFERRED EMBODIMENT

Figure 1:
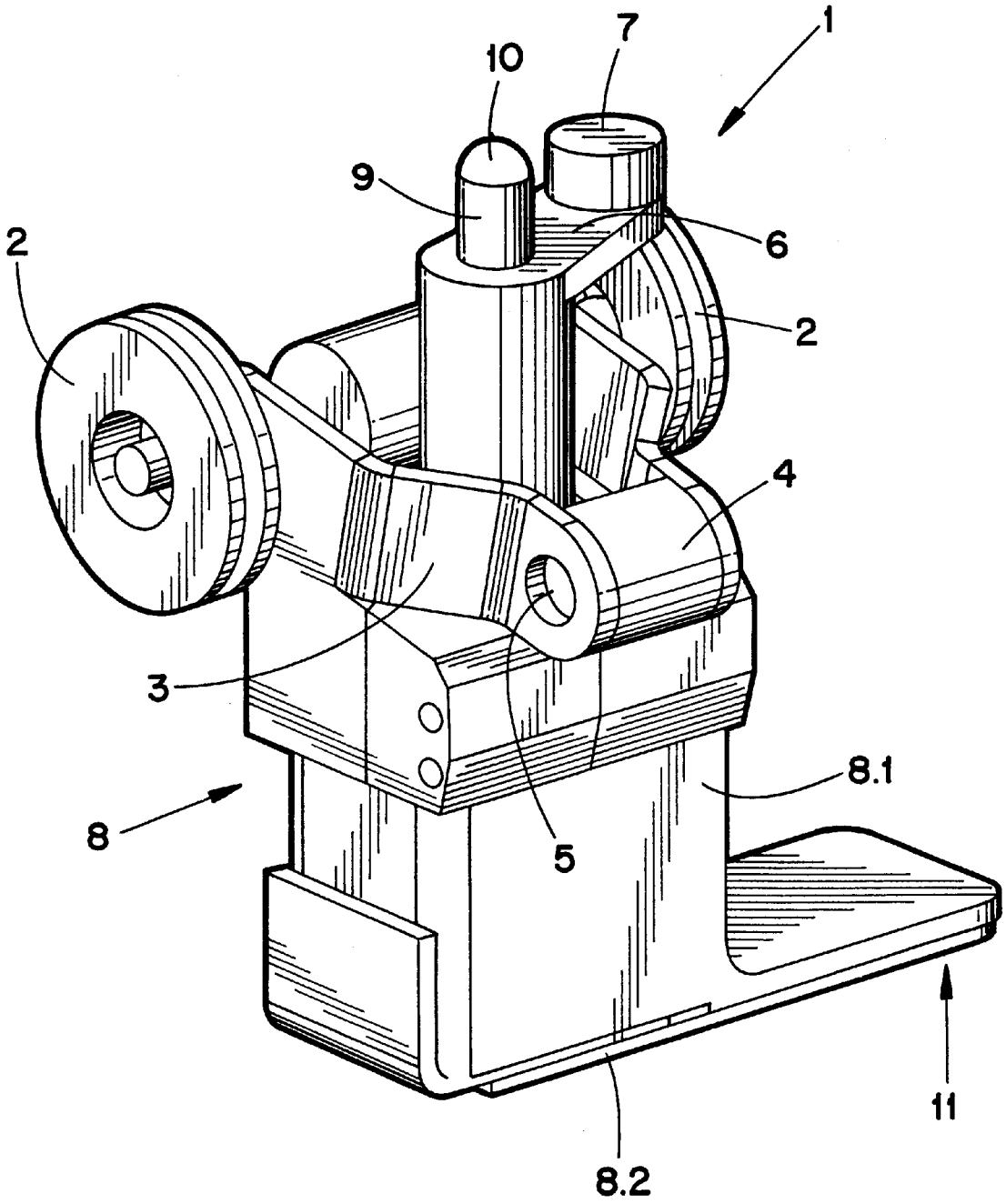
FIG. 1 is a perspective view, diagrammatically illustrating a gripper according to the present invention.

FIG. 1 is a perspective view, diagrammatically illustrating a gripper according to the present invention.

Similar characters of reference designate like parts throughout the different views of the drawings.

A gripper 1 according to the present invention includes an upper stationary gripper 8.1 and a lower movable gripper member 8.2, respectively. The upper stationary gripper member 8.1 is provided with a support 3 on which conveying rolls 2 are arranged. Said support 3 further comprises a connecting link 4 by means of which a plurality of grippers 1 can be arranged in a chain-like fashion, to follow along a conveying track which is arranged after the signature delivery of a folder apparatus and is interconnecting different locations in a mail room.

Said gripper 1 according to the present invention further includes a lever element 6 to which an actuating pad 7 or the like may be fastened. By means of said lever element 6 the stationary member may be rotated with respect to its conveying direction. The stationary gripper 8.1 being stationary should be understood as stationary towards the movable gripper element 8.2. The gripper 1 comprising the gripper body 8 is shown in FIG. 1 in a closed position 11 in which a product, a signature, a newspaper or a flat article in general is seized between the jaws of said stationary gripper element 8.1 and the movable gripper element 8.2. An actuating element 9 such as a substantially vertically extending plunger as provided with the gripper 1 comprises a rounded plunger head 10. On this actuating element 9 an external force is exerted—upon passing a selected mail room location—to move the movable gripper jaw 8.2 with respect to the stationary gripper member 8.1 into the open position 12—designated by reference numeral 12 given in FIG. 1 of the present application.

Figure 2:
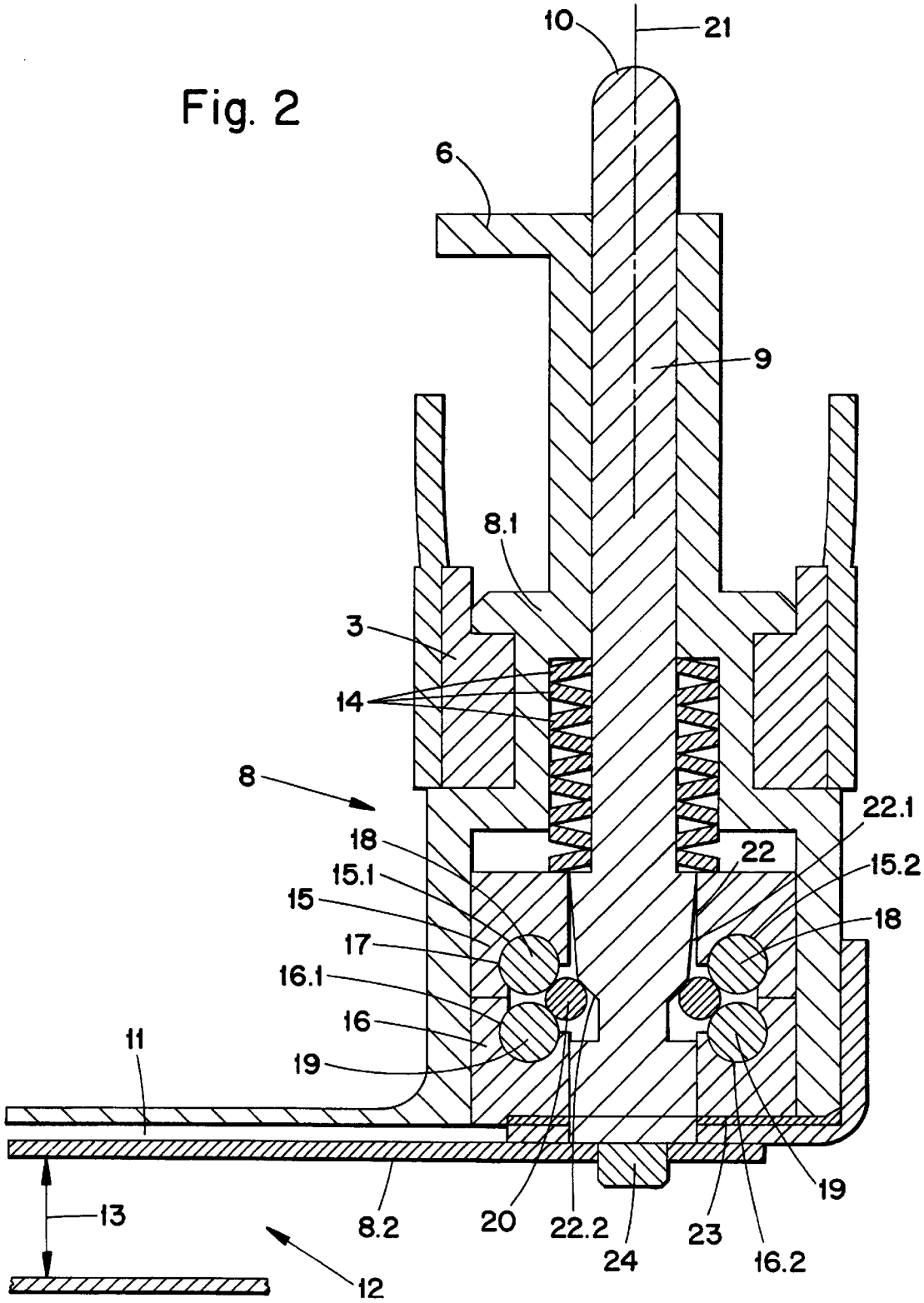
FIG. 2 is a longitudinal cross-sectional view of the gripper as given in FIG. 1.

FIG. 2 is a longitudinal cross-sectional view through a gripper assembly according to the present invention according to FIG. 1.

A gripper body 8 includes a stationary gripper member 8.1 and a movable gripper member 8.2. The gripper 8 may be rotated with respect to the conveying direction of the grippers by actuating said rotating lever 6 assigned to the stationary gripper member 8.1. The stationary gripper member 8.1 is provided with a support jacket 3 as already has been shown in FIG. 1. An actuating means 9 such as a plunger having a rounded head portion 10 is slidably mounted within the stationary gripper member 8.1 for upward and downward movement. On the bottom portion of said plunger 9, the movable gripper member 8.2 is fastened by means of a mounting element 24 and a pad 23 between said movable gripper member 8.2 and a supporting member 16 which will be further described below.

Figure 3:
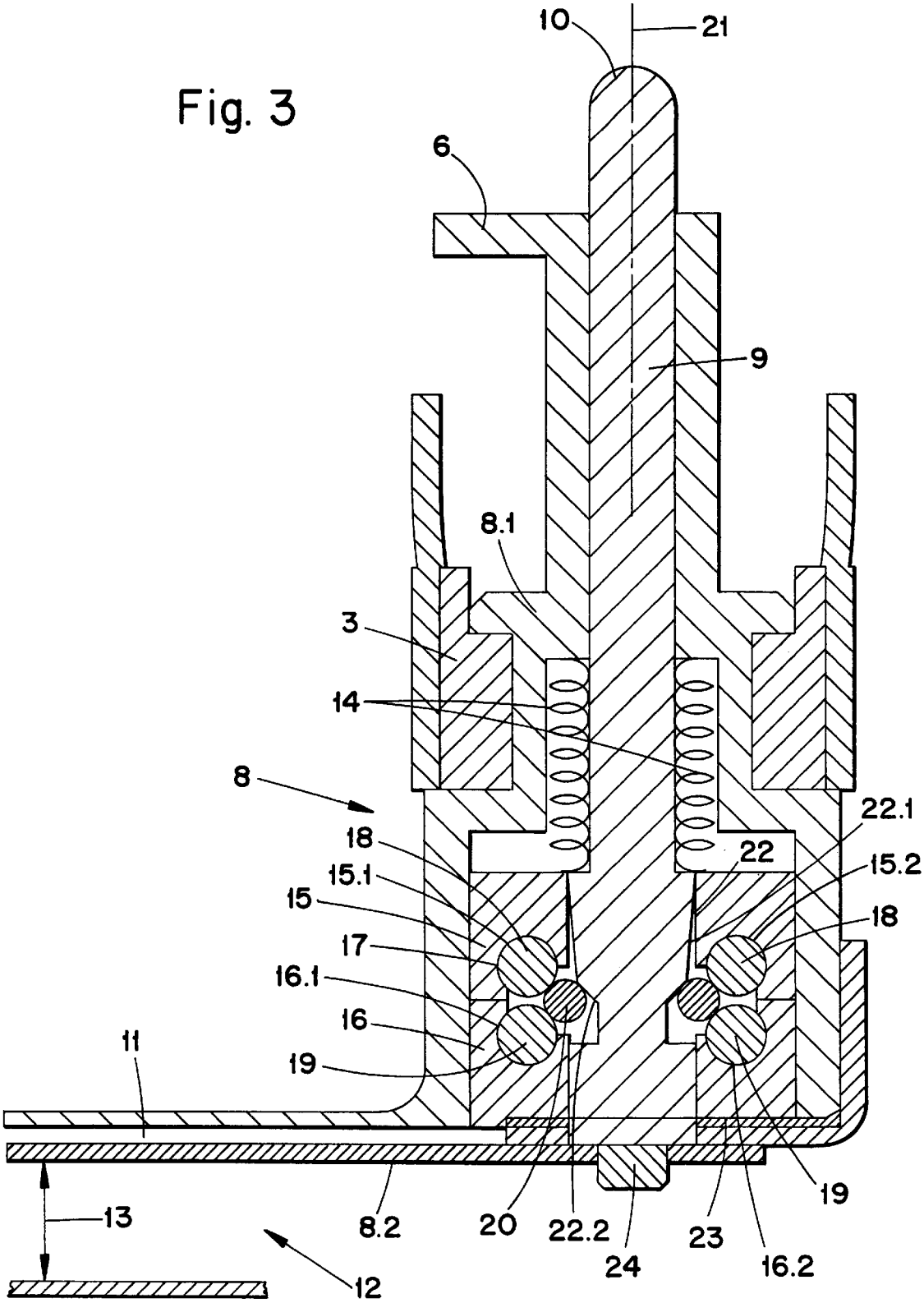
FIG. 3 illustrates another exemplary embodiment of the present invention.
Figure 4:
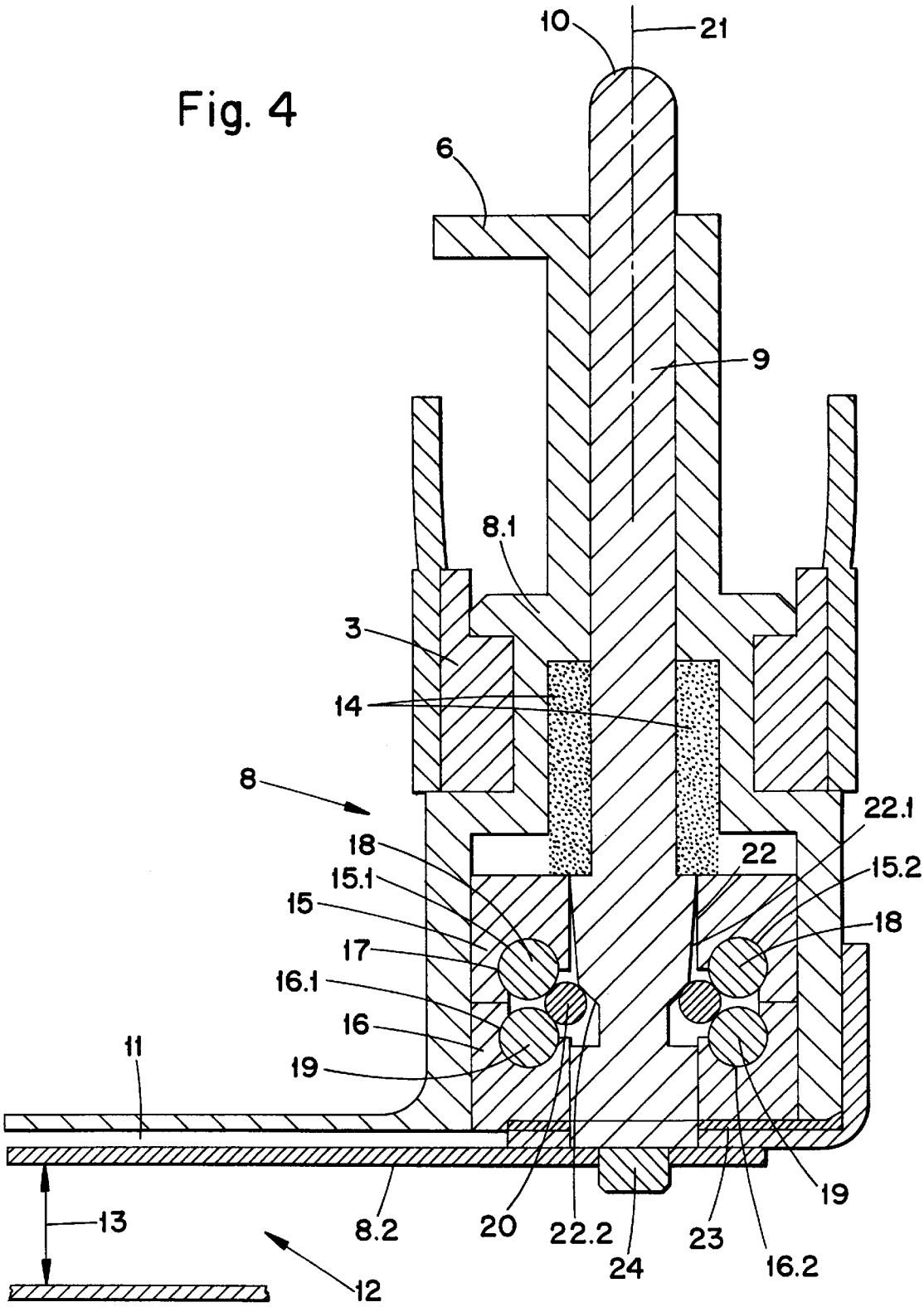
FIG. 4 illustrates yet another exemplary embodiment of the present invention.

In the position given in FIG. 2 the gripper 1 adopts a closed position 11, whereas reference numeral 12 designates an opened position between the stationary gripper member 8.1 and the movable gripper member 8.2. Reference numeral 13 depicts the gripper jaw travel distance upon opening of the gripper jaws of the gripper members 8.1 and 8.2 respectively. Within a hollow interior of said stationary gripper member 8.1 a pushing member 15 and a supporting member 16 are arranged opposite to each other. Said pushing member 15 is pretensioned by a package of springs 14, for example. For pretensioning purposes, spring means 14 such as cup springs, helical springs, and gaseous media could be used. In the embodiment shown in FIG. 2 of the present application a package of cup springs 14 is used, being centered by a portion of said actuating means 9 to pretension said pushing member 15. FIG. 3 shows the spring means 14 comprising a plurality of helical springs, and FIG. 4 shows the spring means 14 being a gaseous media used to exert force. Below said pushing member 15 a supporting member 16 is provided, allowing for a vertical movement of the actuating means 9 upwards and downwards. In the stage shown in FIG. 2, i.e. in the closed position 11, said pushing or supporting means 15, 16 respectively are moved very close with respect to one another. Said supporting elements 15, 16 may have an annular or an approximately rectangular shape.

Both, the pushing member 15 and the supporting member 16 include upper actuating members 18 and lower actuating members 19, respectively. Said actuating members 18, 19, respectively, may be designed as roller bodies having a hardened surface achieved after being subjected to a surface hardening treatment. Actuating members 18, 19 may be shaped as rollers or may have another geometry. Said upper and lower actuating members 18,19, respectively, are mounted in respective recesses 15.1, 15.2 concerning the upper pushing member 15 or can be mounted in corresponding first and second recesses 16.1, 16.2 respectively of the lower supporting member 16. The curvature 17 of said recesses 15.1, 15.2 and 16.1, 16.2 respectively, matches with the outer diameter of said actuating members 18, 19 respectively. In the embodiment given in FIG. 2 contacting members 20 are shown being journaled on the one hand between surfaces of said upper and lower actuating members 18, 19 and on the other hand a cam surface portion 22 assigned to said vertically extending actuating means 9, i.e. a plunger. Said cam surface portions 22 assigned to said actuating means 9 have two portions. Within an upper section 22.1 thereof, the angle of inclination is smaller than the angle of inclination of the lower cam surface portion 22.2 towards the centre line of the actuating means 9. In the closed stage 11 of the gripper 1 given in FIG. 2 said contacting members 20 are urged by said lower cam surface portions 22.2 against the surfaces of the upper and lower actuating members 18, 19 without separating the pushing member 15 from the supporting member 16.

The operation of the gripper 1 according to the present invention is described below:

To release a product seized by the two cooperating gripper jaws of the stationary gripper member 8.1 and the movable gripper member 8.2, an external force is exerted upon the plunger head 10 of the actuating means, i.e. said plunger 9. Thus, a downwardly directed movement is imposed on said plunger 9. By moving into the downward direction, said upper cam surface portion 22.1 will urge the contacting members 20 to move in between the space of the respective upper and lower actuator members 18, 19, respectively. Consequently, upon further downward movement of said plunger 9, the upper pushing member 15 will tend to move against the pretensioning force exerted by the package of springs 14 arranged above said pushing member 15 and about said plunger 9. The upward force imparted to the plunger 9 is a function of the amount the gripper jaws of the stationary gripper member 8.1 and the movable gripper member 8.2 are opened. When the gripper is closed and no external forces are acting on said plunger 9, the grip force will be very high. Upon downward movement of the plunger 9 caused by an externally applied force, the amount of force required to open the gripper jaws decreases as the gripper jaws open wider, however, it is always provided some force so that the jaws will always close if all external forces are removed. By adjusting the shape of the cam surface portions 22 assigned to the plunger 9, the shape of the gripper opening force curve can be controlled. This can be useful when products to be gripped have a variable thickness. Even a flat shape of the curve can be achieved over a specific range of the plunger displacement to compensate for variable product thicknesses.

Once the flat article seized by the jaws of the stationary and the movable gripper members 8.1, 8.2, respectively, are released at a distinct locations, the external forces are removed from said plunger head 10. Due to the compressed state of the package of springs 14, the pushing member 15 moves downward to adopt position given in FIG. 2, i.e. the closed position 11 of the gripper jaws. The respective gripper 1 will follow its conveying track to a location at the mailroom where new flat articles are to be seized and the gripper will be opened in a manner as described above.

It deserves mentioning that said contacting members 20 contacting the various cam surface portions 22.1, 22.2 and the upper and lower actuating means 18, 19 are subject to a surface hardening treatment as well.

It is intended that all matter contained in the above description are shown in the accompanying drawings shall be interpreted as illustration and not in a limiting sense.

What is claimed is:

1. Gripper comprising:

a stationary gripper member, a movable gripper member being relatively movable towards said stationary gripper member, a pretensioning means, a pretensioned actuating member contacting the stationary and the movable gripper members respectively, said pretensioned actuating member having cam surfaces being contacted by contacting members, said contacting members cause the gripper members respectively to close upon removal of external forces on said pretensioned actuating member.

2. Gripper according to claim 1, wherein said stationary gripper member comprises a rotating lever for rotational movement thereof.

3. Gripper according to claim 1, wherein said stationary gripper member is mounted within a conveying support having guiding members for a conveying track.

4. Gripper according to claim 3, wherein said conveying supports have contacting links for a chain-like connection of a plurality of grippers.

5. Gripper according to claim 1, wherein said stationary gripper member comprises a hollow interior, in which a pushing member and a supporting member are mounted.

6. Gripper according to claim 5, wherein said pushing member and said supporting member are mounted for relative movement towards one another.

7. Gripper according to claim 5, wherein said pushing member is pretensioned by a spring means.

8. Gripper according to claim 7, wherein said spring means is a package of cup springs.

9. Gripper according to claim 7, wherein said spring means are helical springs.

10. Gripper according to claim 7, wherein said spring means is a gaseous medium.

11. Gripper according to claim 5, wherein said supporting member is mounted to said movable gripper member.

12. Gripper according to claim 5, wherein each of the pushing member and the supporting member respectively, cooperate with upper and lower actuating means.

13. Gripper according to claim 12, wherein said actuating means are roller bodies with hardened surfaces.

14. Gripper according to claim 12, wherein said actuating means are mounted in recesses of said pushing and supporting members respectively.

15. Gripper according to claim 12, wherein contacting members are journaled between surfaces of said actuating means and cam surface portions of said actuating member.

16. Gripper according to claim 1, wherein the pretensioning actuating member has a lower cam surface portion, and the gripper members are held in a closed position upon contact of the contacting members with said lower cam surface portion.

17. Gripper according to claim 1, wherein the gripper members adopt an open position upon contact of the contacting members with an upper cam surface portion assigned to said actuating members.

18. Method for actuating a gripper between a closed position and an opened position comprising the steps of:

moving a movable gripper member into at least one of a closed position and an open position with respect to a stationary gripper member, said step of moving further including at least one of a step of:

contacting members contacting lower cam surface portions of an actuating means and surfaces of roller bodies of pushing and supporting means in a closed position, and contacting members contacting upper cam surface portions of an actuating means and surfaces of roller bodies of pushing and supporting means in an opened position.

* * * * *